United States Patent [19]

Morse et al.

[11] Patent Number: 4,791,421

[45] Date of Patent: Dec. 13, 1988

[54] TRANSMIT-RECEIVE MODULE FOR PHASED-ARRAY ANTENNAS

[75] Inventors: Alfred W. Morse, Ellicott City; Daniel C. Buck, Hanover; Charles H. Grauling, Jr., Ellicott City, all of Md.

[73] Assignee: Westinghouse Electric Corp., Pittsburgh, Pa.

[21] Appl. No.: 905,904

[22] Filed: Sep. 10, 1986

[51] Int. Cl.[4] ..... H01Q 3/26

[52] U.S. Cl. ..... 342/368; 342/374

[58] Field of Search ..... 342/374, 368; 330/289

[56] References Cited

U.S. PATENT DOCUMENTS

| | | | |
|---|---|---|---|
| 1,669,123 | 5/1928 | Espenschied et al. | 342/368 |
| 3,667,064 | 5/1972 | Thorton et al. | 330/289 |
| 3,704,419 | 11/1972 | Rheinfelder | 330/289 |
| 3,956,699 | 5/1976 | Leahy | 342/368 |
| 4,516,126 | 5/1985 | Masak et al. | 342/383 |
| 4,641,141 | 2/1987 | Masak | 342/379 |
| 4,673,939 | 6/1987 | Forrest | 342/174 |

*Primary Examiner*—Theodore M. Blum
*Assistant Examiner*—David Cain
*Attorney, Agent, or Firm*—W. G. Sutcliff

[57] ABSTRACT

Coupling module for use with phased-array antenna systems. The module includes separate phase shifters for the transmit and receive paths through the module. The transmit path also includes a power amplifier and the receive path includes a small signal, low noise amplifier. The two paths are coupled to the antenna radiating element by a transmit-receive switch or by a microwave circulator. A conducting septum is located between the devices in the transmit and receive paths to increase the isolation between the two paths. The individual phase shifters are optimized for unidirectional flow of comparatively large or small microwave signals and for the degree of desired phase shift resolution. By using vector modulators for the phase shift devices, the amplitude of the signal in the path can be compensated for temperature and frequency variations in the path.

18 Claims, 2 Drawing Sheets

TRANSMIT-RECEIVE MODULE FOR PHASED-ARRAY ANTENNAS

BACKGROUND OF THE INVENTION

This invention relates, in general, to electronic apparatus and, more specifically, to phasing modules for use with active phased-array antennas.

Active phased-array radar systems have a multitude of signal amplifying and phase shifting modules located at the antenna element positions. These modules amplify the transmitted signals which are then radiated by the antenna elements and also amplify the returned echo signals received by the antenna elements. The modules also furnish the signal phase shifts necessary for obtaining the desired pattern and gain from the antenna system. A manifold system is used to connect all of the modules to the common components of the radar system, such as the pulse signal generator and the echo signal processor.

Traditionally, these modules, which must amplify and phase shift both the transmitted and received signals, have used the same phase shifting components for both the transmitted and the received signals. In order to accomplish this, transmit-receive (T/R) switches were used in the module to switch the phase shifting components, or devices, into either the transmitted signal path or into the received signal path. Certain problems are inherent in switching the phase shifting devices between the transmit and receive paths in the module. These problems include the fact that the phase shifter must work bidirectionally, and also the fact that the phase shifter must handle a comparatively wide range of signal powers. In addition, the phase shifter must operate at different duty cycles in the transmit and receive paths. These requirements limit the types of phase shifter circuits which can be used and require a compromise in the phase shifter design and operating parameters in order to be compatible and functional as the plane shifting component for both the transmitted and received signals.

In addition to the problems associated with a common phase shifter used in the module, several unique characteristics are desirable for the phase shifters in the transmit and receive paths which cannot be easily realized with bidirectional phase shifters. For example, it is often desirable to have a different amount of bit resolution for a digitally controlled phase shifter when working with the transmit or receive signal. Ordinarily, a higher bit resolution is required when shifting phases of the received signal. Also, it is desirable to increase amplification of the amplifiers in the modules without having oscillation problems. It is also desirable to have the ability to compensate for shifter performance with changes in the temperature and frequency of the signal circuit in which they are operating.

Therefore, it is desirable, and it is an object of this invention, to provide a module which removes many of the previous restrictions on phase shifters and affords the realization of the desired characteristics. It is also an object of this invention to provide this type of module in a small, economical and efficient device.

SUMMARY OF THE INVENTION

There is disclosed herein a new and useful device for use as a coupling, amplifying and phase shifting module at the element locations of a phased-array antenna. The module includes, according to one embodiment of the invention, separate phase shifters located in the transmit and receive paths of the module, which are not switched to the other path at any time during the operation of the module. Each phase shifter is dedicated to that particular path and can be compensated, or optimized, for the performance desired in that path. The two signal paths are connected to the common antenna radiating element by a single transmit-receive switch. A two-stage power amplifier system is used in the transmit path, and a low noise amplifier and a receiver protecting device is used in the receive path of the module. A conducting septum is positioned between the elements of the two paths in order to isolate the paths and to reduce the signal leakage between the output of one path and the input of the other path. By using separate phase shifters in the transmit-receive module, the phase shifters need only operate in one direction. The interfaces between the adjacent components can be optimized for the most efficient coupling between these components, thereby providing one of the methods by which the present invention increases the efficiency over the prior art T/R modules which use bidirectional phase shifters.

According to another embodiment of the invention, vector modulators are used to control not only the phase in the two signal paths, but also the amplitude of the signals. The signal amplitude can be controlled in response to temperature sensors in the particular path where the modulator is located. In addition, the vector modulators can compensate for frequency variations in the output of the amplifiers associated with the modulators. Variations in the construction of the module of this invention include the use of circulators to connect or couple the antenna elements to the elements in the transmit and receive paths.

In each embodiment of the invention, the transmit and receive paths are connected to separate transmit and receive manifolds which combine all of the transmit-receive modules. In antenna systems which have a common manifold for both transmit and receive, the device of this invention can be used by combining the two signal paths with the use of a circulator or a transmit-receive switch and connecting the combined output to the common manifold connection.

BRIEF DESCRIPTION OF THE DRAWINGS

Further advantages and uses of this invention will become more apparent when considered in view of the following detailed description and drawings, in which.

DESCRIPTION OF THE PREFERRED EMBODIMENTS

Figure 1:
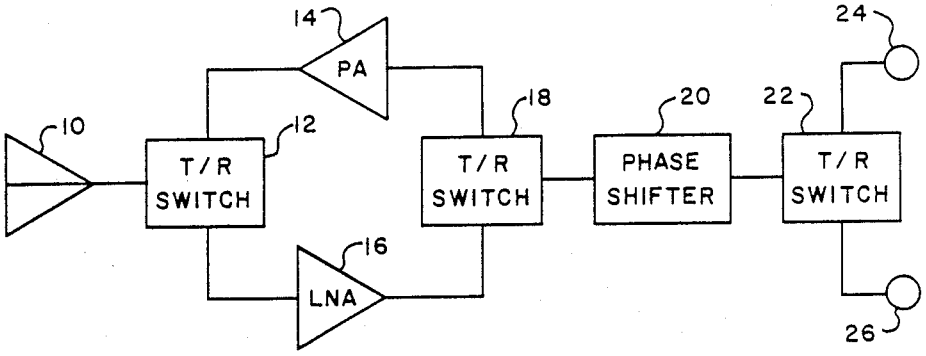
FIG. 1 PRIOR ART
FIG. 1 is a block diagram of a transmit-receive module constructed according to the prior art.

Throughout the following description, similar reference characters refer to similar elements or members in all of the figures of the drawings.

Referring now to the drawings, and to FIG. 1 in particular, there is shown a transmit-receive module constructed according to the prior art. Similar modules would be associated with each of the independent antenna radiating elements of the phased-array antenna system. The antenna element 10 is connected to the transmit-receive (T/R) switch 12 which is activated and controlled by the antenna control system. When the antenna is transmitting a signal, the T/R switch connects the antenna 10 to the power amplifier 14. When the antenna is receiving signals, the T/R switch 12 connects the antenna 10 to the low noise amplifier 16. T/R switch 18 is controlled to switch either the transmit or receive branch to the phase shifter 20, which is connected to the T/R switch 22. The T/R switch 22 connects the module to either the terminal 24 or the terminal 26, which are associated with the transmit and receive manifolds, or summing networks, of the antenna feed system.

The phase shafter 20 used in the T/R module of FIG. 1 must be capable of shifting the phase of the signals passing therethrough in either direction. This bidirectional requirement necessitates certain design parameters and trade-offs in the construction of a phase shifter suitable for use in the prior art circuit. In addition to the restrictions on the phase shifter 20, the circuit of FIG. 1 must be carefully designed to minimize the occurrence of an undesirable loop gain around the switches 12 and 18 and the amplifiers 14 and 16 to prevent oscillations in the module. This is necessary since the T/R switches 12 and 18 have a finite amount of leakage in their open position, thus causing some signal to pass to the branch not being used. If the gains of the amplifiers 14 and 16 are sufficient, the leakage through the switches 12 and 18 will return an inphase signal back to the input of PA amplifier 14, thereby causing undesirable oscillations to occur in the module. Therefore, restrictions on the gain of the amplifiers 14 and 16 is inherent in the design of such a module and can limit the desired performance.

Figure 2:
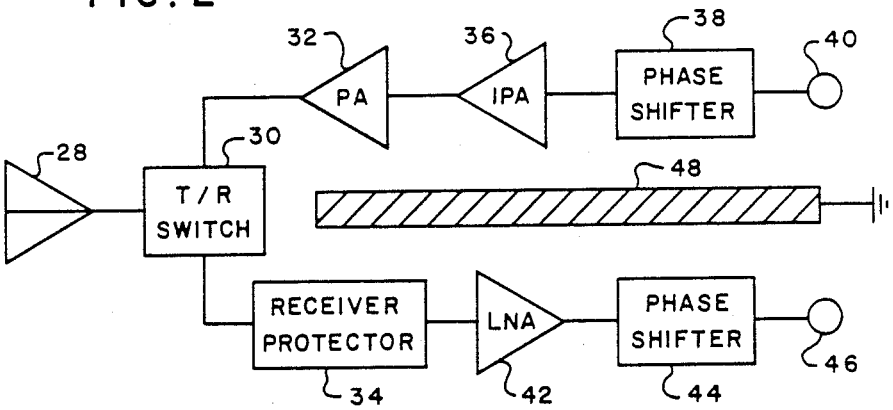
FIG. 2 is a block diagram of a transmit-receive module constructed according to one embodiment of this invention.

FIG. 2 is a block diagram of a T/R module constructed according to one embodiment of the invention. This arrangement of components provides for more efficient operation of the T/R module and also provides for more versatility in the ability of the T/R module to adjust or compensate for different conditions and design criteria. According to FIG. 2, the antenna element 28 is connected to the T/R switch 30 which is controlled by conventional means to connect the antenna to the branch containing either the power amplifier 32 when in the transmit mode, or to the receiver protector 34 when in the receive mode. The transmit branch, or path, also includes the intermediate power amplifier 36 and the phase shifter 38 which is connected to the transmit manifold connection, or terminal, 40. The receiving branch, or path, also includes the low noise amplifier 42 and the separate phase shifter 44 which is connected to the terminal, or connection, 46 of the receive manifold. A conducting septum, shield, or barrier 48 is located between the two branches of the T/R module and is connected to ground potential. The purpose of the conducting septum is to isolate the components included in the separate transmit and receive branches to improve the ability of the system to prevent oscillations. This is possible with the system of FIG. 2 since there is no second T/R switch, as in FIG. 1, to leak signals in the receive path back to the input of the transmit path.

The T/R switch 30 shown in FIG. 2 may be constructed similar to the T/R switches shown in FIG. 1, or according to any of the known designs used for switching microwave signals, such as the use of PIN diodes. The separate final and intermediate amplifiers, 32 and 36 respectively, are also constructed of conventional devices known to those skilled in the art, and it is within the contemplation of the invention that more or less stages may be used for amplification of the transmitted microwave signal. The receiver protector 34 in this embodiment is a gallium-arsenide field effect transistor (GAS-FET), although back-to-back diodes can be used in some applications. The low noise amplifier 42 is also of conventional design, although the lack of leakage problems associated with the module of FIG. 2 may permit the amplifier 42 to have higher gain than that of corresponding amplifiers in prior art modules.

The T/R module shown in FIG. 2 has certain advantages over prior art T/R modules. For example, since the phase shifters 38 and 44 are used for only one purpose, either transmit or receive, they can be more suitably optimized or compensated to perform their desired function than the dual purpose phase shifter 20 shown in FIG. 1. The transmit path phase shifter 38 should be primarily a low loss, low duty cycle, high power device with medium accuracy or resolution. A phase shifter built with PIN diodes or an FET operating as a gate controlled resistor (GCR) can support these requirements. The phase shifter 44 in the receive path can have higher insertion loss than the transmit phase shifter without degrading from the circuit performance. A phase shifter constructed using field effect transistors for the receive path phase shifter 44 is desirable in some applications. Since the degree of resolution of phase shift is usually desired to be greater in the receive path, different degrees of phase shift resolution may be constructed in each phase shifter. For example, the phase shifter 38 may have a bit resolution of 4 bits whereas the phase shifter 44 may have a bit resolution of 6 bits. Having separate phase shifters also allows for independent disabling of the phase shifters for testing and array calibration.

Figure 3:
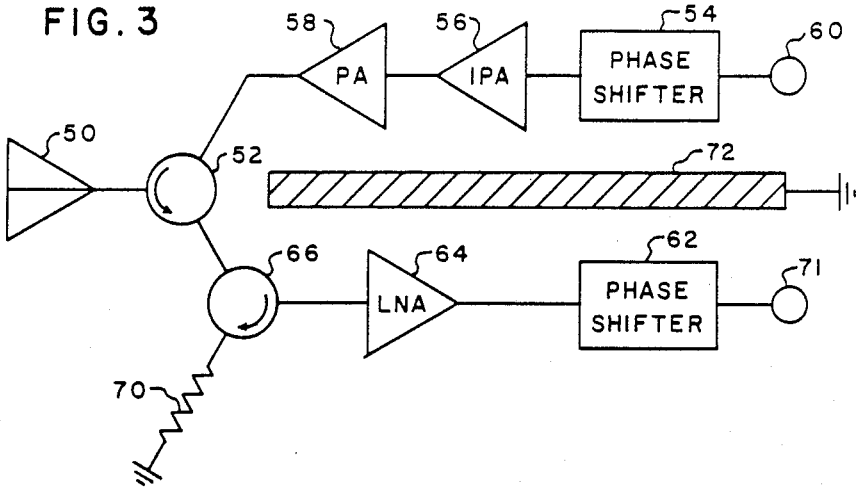
FIG. 3 is a block diagram of a transmit-receive module constructed according to another embodiment of this invention.

FIG. 3 is a diagram illustrating a T/R module constructed according to another embodiment of the invention. In this embodiment, circulators are used to perform the function of switching provided for in the previous embodiment by other types of components. According to FIG. 3, the antenna element 50 is connected to one terminal, or port, of the circulator 52. The transmitting branch, or path, of the module consists of the phase shifter 54, the intermediate power amplifier 56, and the final power amplifier 58 which is connected to another port of the circulator 52. The phase shifter 54 is also connected to the terminal, or connector, 60 of the transmit manifold.

The receive path of the module includes the phase shifter 62, the low noise amplifier 64, and the circulator 66. Circulator 66 effectively performs the function of isolating the low noise amplifier 64 from the circulator 52 with respect to reflected signals from the amplifier 64. That is, reflected signals from the amplifier 64 are dissipated in the resistance terminator 70 rather than passing through the port connected to the circulator 52. The conducting septum 72 is positioned physically and electrically between the two paths of the module. The phase shifter 62 is connected to the terminals, or connection, 71 which goes to the receive manifold of the antenna system.

Since the two branches or paths of the T/R module constructed according to this invention use separate phase shifters, individual compensating or optimizing of the errors in the phase shifters may be achieved. For example, the temperature in the particular path the phase shifter is located may be monitored to control the characteristics of the phase shifter. In addition, other quantities may be controlled independently, such as frequency dependent quantities and, as previously stated, the bit resolution of the phase shifters. In addition to being capable of individual optimizing, the phase shifting means may also include active phase shifting techniques, such as the use of vector modulators or complex weighting circuits. These phase shifters also permit changing the amplitude of the signal.

Figure 4:
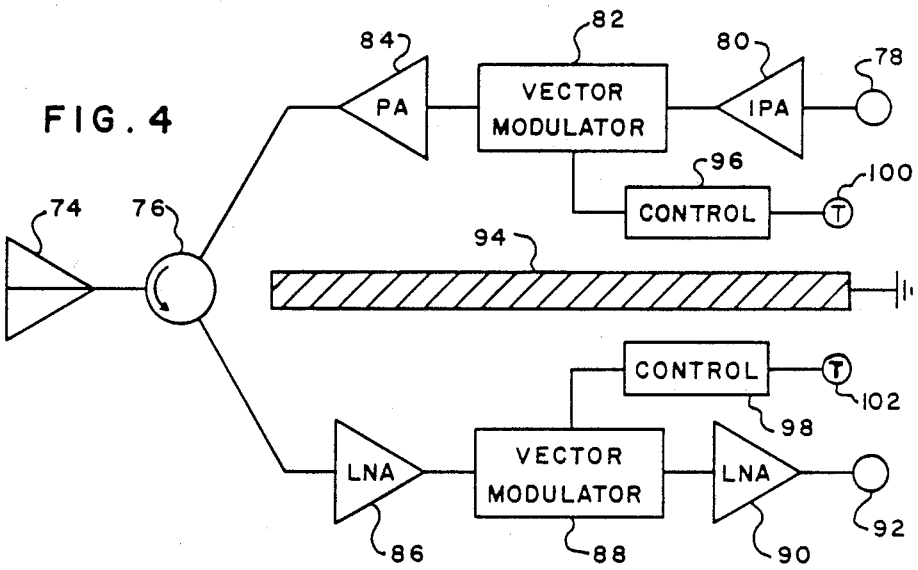
FIG. 4 is a block diagram of a transmit-receive module constructed according to still another embodiment of the invention.

FIG. 4 illustrates an embodiment of the invention wherein vector modulators are used as active phase shifters is each path of the module. According to FIG. 4, the antenna element 74 is connected to the circulator 76. The transmit branch, or path, of the module extends from the transmit manifold connection 78, through the intermediate power amplifier 80, the vector modulator 82, and the power amplifier 84, to the circulator 76. The receive path of the module extends from the circulator 76, through the low noise amplifier 86, the vector modulator 88, and the low noise amplifier 90, to the receive manifold connection 92. A conducting septum 94 is located between the two paths. Each vector modulator is controlled by a control circuit, such as the control circuits 96 and 98 which are connected to the temperature sensors 100 and 102, respectively.

According to this specific embodiment, the temperature in the transmit path influences the amplitude control of the vector modulator 82. Similarly, the temperature in the receive path controls the amplitude passing through the vector modulator 88. In addition to controlling the amplitudes in such an active fashion, the vector modulators 82 and 88 also shift the phase of the signals. Besides temperature compensation, the control circuits for the vector modulators can be dependent upon the frequency of the signal applied to the modulators, thereby providing more linear response than is achievable with prior art T/R modules. Since vector modulators perform best, because of dynamic range preservation, when located within the amplification chain, vector modulator 82 is located between the two power amplifier stages. Similarly, the vector modulator 88 is located between the low noise amplifier stages 86 and 90, although it is within the contemplation of this invention that, in certain applications, only one stage of amplification may be used in the transmit and/or receive paths of the T/R module. The vector modulators can also be used in an S.T.C. (Sensitivity Time Control) function in which LNA gain is reduced to preserve linearity of the output LNA stage when the received signal is large enough to drive the output stage into compression.

Figure 5:
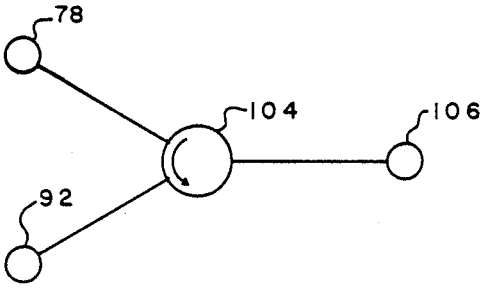
FIG. 5 is a diagram showing one arrangement for connecting the module of this invention to a common transmit-receive manifold.

Using separate transmit and receive manifolds, or summing networks, permits an antenna system with different tapers, or coupling to the antenna elements, on transmit and receive. When this is not desired, or when a common manifold is desirable for other reasons, the two separate transmit and receive manifolds may be combined into one manifold. When the T/R modules of this invention are to be used with antenna systems having a one-manifold system, the input and output terminals or connections must be combined. FIG. 5 illustrates one method for combining the separate transmit and receive paths into one path. According to FIG. 5, the one-path combiner is provided by the circulator 104 which is connected to the transmit path terminal 78 and the receive path terminal 92, which are also shown in FIG. 4. The combiner combines the two paths and provides connection to the common terminal, or connection, 106. Instead of using a circulator for this combining function, a transmit-receive switch may be used without departing from the scope of the invention.

The use of separate phase shifters in the transmit and receive paths of the module does not necessarily produce a module which is more complex than the prior art modules. Although an extra phase shifter is present, its design is inherently less complicated because it needs only to pass signals unidirectionally. In addition, the elimination of at least one T/R switch is also a factor which influences the reduced complexity of the circuit. Also, the better circuit performance of individually optimized phase shifters for each circuit may permit less complex amplifiers in the circuit without degrading the overall performance. Tests have shown that the performance and efficiency of the two-path phase shafter module is superior to that of the prior art modules.

Since the use of separate phase shifters in the transmit and receive paths of the module, and the use of the other features of the invention, allow for new component selection and design, a more efficient and better performing transmit-receive module may be constructed according to the teachings of this invention. It is emphasized that numerous changes may be made in the above-described module without departing from the teachings of the invention. It is intended that all of the matter contained in the foregoing description, or shown in the accompanying drawings, shall be interpreted as illustrative rather than limiting.

We claim as our invention:

1. A transmit-receive module for connection to radiating element positions of an active phased-array antenna system having a transmit and receive manifold system, said module comprising:

a single means for dividing a signal path between an associated radiating element and a transmit and receive manifold system into transmit and receive signal paths;

first phase shifting means in said transmit path for shifting the phase of signals passing through said transmit path from said transmit and receive manifold system to the dividing means, said first phase shifting means having a first preselected degree of bit resolution;

second phase shifting means in said receive path for shifting the phase of signals passing through said receive path from said dividing means to said transmit and receive manifold system, said second phase shifting means operating independently of and electrically isolated from said first phase shifting means, said second phase shifting means having a second preselected degree of bit resolution which is greater than said first preselected degree of bit resolution; and means for connecting said first and second phase shifting means to the manifold system of the phased-array antenna.

2. The transmit-receive module of claim 1 wherein the dividing means is a transmit-receive switch.

3. The transmit-receive module of claim 1 wherein the dividing means is a circulator.

4. The transmit-receive module of claim 1 wherein the module includes a power amplifier in the transmit path.

5. The transmit-receive module of claim 1 wherein the module includes a low noise amplifier in the receive path.

6. The transmit-receive module of claim 1 wherein the module includes a receiver protector in the receive path.

7. The transmit-receive module of claim 1 wherein the first phase shifting means is a phase shifter utilizing a PIN diode.

8. The transmit-receive module of claim 1 wherein the first phase shifting means is a phase shifter utilizing an FET operating as a gate controlled resistor.

9. The transmit-receive module of claim 1 wherein the second phase shifting means is a phase shifter utilizing a small signal field effect transistor.

10. The transmit-receive module of claim 1 wherein the module includes a conducting septum physically located between the transmit and receive signal paths.

11. The transmit-receive module of claim 1 wherein the module includes splitting means for connecting the separate transmit and receive paths to a common manifold system.

12. The transmit-receive module of claim 1 wherein the module includes a power amplifier in the transmit path and a low noise amplifier in the receive path.

13. A transmit-receive module for connection to radiating element positions of a phased-array antenna system having a transmit and receive manifold system, said module comprising:

means for dividing a signal path between an associated radiating element and a transmit and receive manifold system into transmit and receive signal paths;

a first phase shifter located in the transmit signal path, said phase shifter utilizing a PIN diode to shift the phase and having a first bit resolution;

a second phase shifter located in the receive signal path, said phase shifter utilizing a small signal field effect transistor to shift the phase and having a second bit resolution, said second bit resolution being greater than said first bit resolution;

power amplifier means located in the transmit signal path;

low noise amplifier means located in the receive signal path;

means for connecting said first and second phase shifters to the manifold system of the phase-array antenna;

a conducting septum physically located between said first and second phase shifters to prevent oscillation between said first and second phase shifters; and said first phase shifter operating independently of and electrically isolated from said second phase shifter.

14. A transmit-receive module for connection to radiating element positions of an active phased-array antenna system having a transmit and receive manifold system, said module comprising:

means for dividing a signal path between an associated radiating element and a transmit and receive manifold system into transmit and receive signal paths;

first vector modulator means in said transmit path for shifting the phase and changing the amplitude of signals passed through said transmit path from said transmit and receive manifold system to said dividing means;

second vector modulator means in said receive path for shifting the phase and changing the amplitude of signals passed through said receive path from said dividing means to said transmit and receive manifold system, said second vector modulator means operating independently of and electrically isolated from said first vector modulator means; and means for connecting said first and second vector modulator means to said transmit and receive manifold system.

15. The transmit-receive module of claim 14 wherein said first and second vector modulator means are independently controlled to change the amplitude of the signal in each path.

16. The transmit-receive module of claim 15 wherein the control is dependent upon signals provided from temperature sensors.

17. A transmit-receive module for connection to radiating element positions of a phased-array antenna system having a transmit and receive manifold system, said module comprising:

means for dividing a signal path between an associated radiating element and a transmit and receive manifold system into transmit and receive signal paths;

first vector modulator means in said transmit path for shifting the phase and changing the amplitude of signals passed through said transmit path from said transmit and receive manifold system to said dividing means;

second vector modulator means in said receive path for shifting the phase and changing the amplitude of signals passed through said receive path from said dividing means to said transmit and receive manifold system, said first and second vector modulator means being controlled independently of each other in response to temperature signals, said first and second vector modulator means operating independently of and electrically isolated from each other;

power amplifier means positioned in said transmit signal path;

low noise amplifier means positioned in said receive signal path;

means for connecting said first and second vector modulator means to said phased-array antenna manifold system; and a conducting septum physically positioned between said first and second vector modulator means to prevent oscillation between said first and second vector modulator means.

18. The transmit-receive module of claim 17 wherein:

said power amplifier means includes at least two stages with one of said vector modulator means positioned therebetween; and said low noise amplifier includes at least two stages with the other of said vector modulator means positioned therebetween.

* * * * *